US009901805B2

(12) United States Patent
Hughes, Jr.

(10) Patent No.: US 9,901,805 B2
(45) Date of Patent: Feb. 27, 2018

(54) EXERCISE SYSTEM

(71) Applicant: Leon Hughes, Jr., Lawrenceville, GA (US)

(72) Inventor: Leon Hughes, Jr., Lawrenceville, GA (US)

( * ) Notice: Subject to any disclaimer, the term of this patent is extended or adjusted under 35 U.S.C. 154(b) by 0 days.

(21) Appl. No.: 15/130,580

(22) Filed: Apr. 15, 2016

(65) Prior Publication Data

US 2017/0296900 A1 Oct. 19, 2017

(51) Int. Cl.

| | |
|---|---|
| ***A63B 15/02*** | (2006.01) |
| ***A63B 71/00*** | (2006.01) |
| ***A63B 22/02*** | (2006.01) |
| ***A47B 21/00*** | (2006.01) |
| ***A47B 9/20*** | (2006.01) |
| ***A47B 13/16*** | (2006.01) |

(52) U.S. Cl.
CPC ..... *A63B 71/00* (2013.01); *A47B 9/20* (2013.01); *A47B 13/16* (2013.01); *A47B 21/00* (2013.01); *A63B 22/02* (2013.01)

(58) Field of Classification Search
CPC ..... A63B 22/02–22/0264; A63B 71/00; A63B 2225/093; A47B 2021/0076; A47B 21/00; A47B 2200/0066
USPC ..... 108/50.01, 50.02
See application file for complete search history.

(56) References Cited

U.S. PATENT DOCUMENTS

| | | | | |
|---|---|---|---|---|
| 5,383,632 | A * | 1/1995 | Shirlin | A47B 21/0371 248/118.5 |
| 5,405,195 | A * | 4/1995 | Hobbs | A47B 88/57 312/334.32 |
| 6,224,516 | B1 * | 5/2001 | Disch | A63B 22/02 482/51 |
| 7,614,991 | B2 | 11/2009 | Fox | |
| 7,892,148 | B1 * | 2/2011 | Stauffer | A63B 22/0235 482/51 |
| D691,223 | S | 10/2013 | Hao | |
| 8,876,662 | B2 * | 11/2014 | Hao | A47B 37/00 482/4 |
| 9,737,138 | B1 * | 8/2017 | Siebert | A47B 37/00 |
| 2004/0254020 | A1 * | 12/2004 | Dragusin | A47C 7/72 463/46 |
| 2006/0247109 | A1 | 11/2006 | Powell | |
| 2006/0287617 | A1 * | 12/2006 | Taub | A61H 1/02 601/24 |
| 2007/0228680 | A1 * | 10/2007 | Reppert | A47B 21/00 280/47.35 |
| 2008/0084147 | A1 * | 4/2008 | Brown | A47B 83/001 312/223.3 |
| 2008/0234111 | A1 | 9/2008 | Packham | |
| 2012/0026663 | A1 * | 2/2012 | Costamagna | A47B 21/00 361/679.22 |
| 2012/0088633 | A1 * | 4/2012 | Crafton | A63B 22/0235 482/1 |
| 2012/0174833 | A1 | 7/2012 | Early et al. | |

(Continued)

FOREIGN PATENT DOCUMENTS

WO WO2008030366 3/2008

*Primary Examiner* — Gregory Winter

(57) ABSTRACT

An exercise system for incorporating physical exercise with sedentary job tasks includes a treadmill that may be walked upon. A workstation is coupled to the treadmill and the workstation is accessible when the treadmill is walked upon. Thus, job tasks may be undertaken simultaneously with physical exercise.

10 Claims, 6 Drawing Sheets

(56) References Cited

U.S. PATENT DOCUMENTS

| | | | | |
|---|---|---|---|---|
| 2013/0150214 | A1* | 6/2013 | Wu | A63B 71/0622 482/4 |
| 2013/0200660 | A1* | 8/2013 | Bahnof | A47B 21/00 297/135 |
| 2014/0080678 | A1* | 3/2014 | Wu | A63B 22/02 482/54 |
| 2014/0187383 | A1* | 7/2014 | Martin | A47B 83/04 482/8 |
| 2015/0250304 | A1* | 9/2015 | Dalebout | A63B 22/02 482/54 |
| 2015/0251047 | A1* | 9/2015 | Maaniitty | A47B 21/02 482/54 |
| 2016/0038785 | A1* | 2/2016 | Netter | A63B 22/0235 482/4 |
| 2016/0088931 | A1* | 3/2016 | Schneider | A47B 21/03 108/28 |

* cited by examiner

EXERCISE SYSTEM

BACKGROUND OF THE DISCLOSURE

Field of the Disclosure

The disclosure relates to exercise devices and more particularly pertains to a new exercise device for incorporating physical exercise with sedentary job tasks.

SUMMARY OF THE DISCLOSURE

An embodiment of the disclosure meets the needs presented above by generally comprising a treadmill that may be walked upon. A workstation is coupled to the treadmill and the workstation is accessible when the treadmill is walked upon. Thus, job tasks may be undertaken simultaneously with physical exercise.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
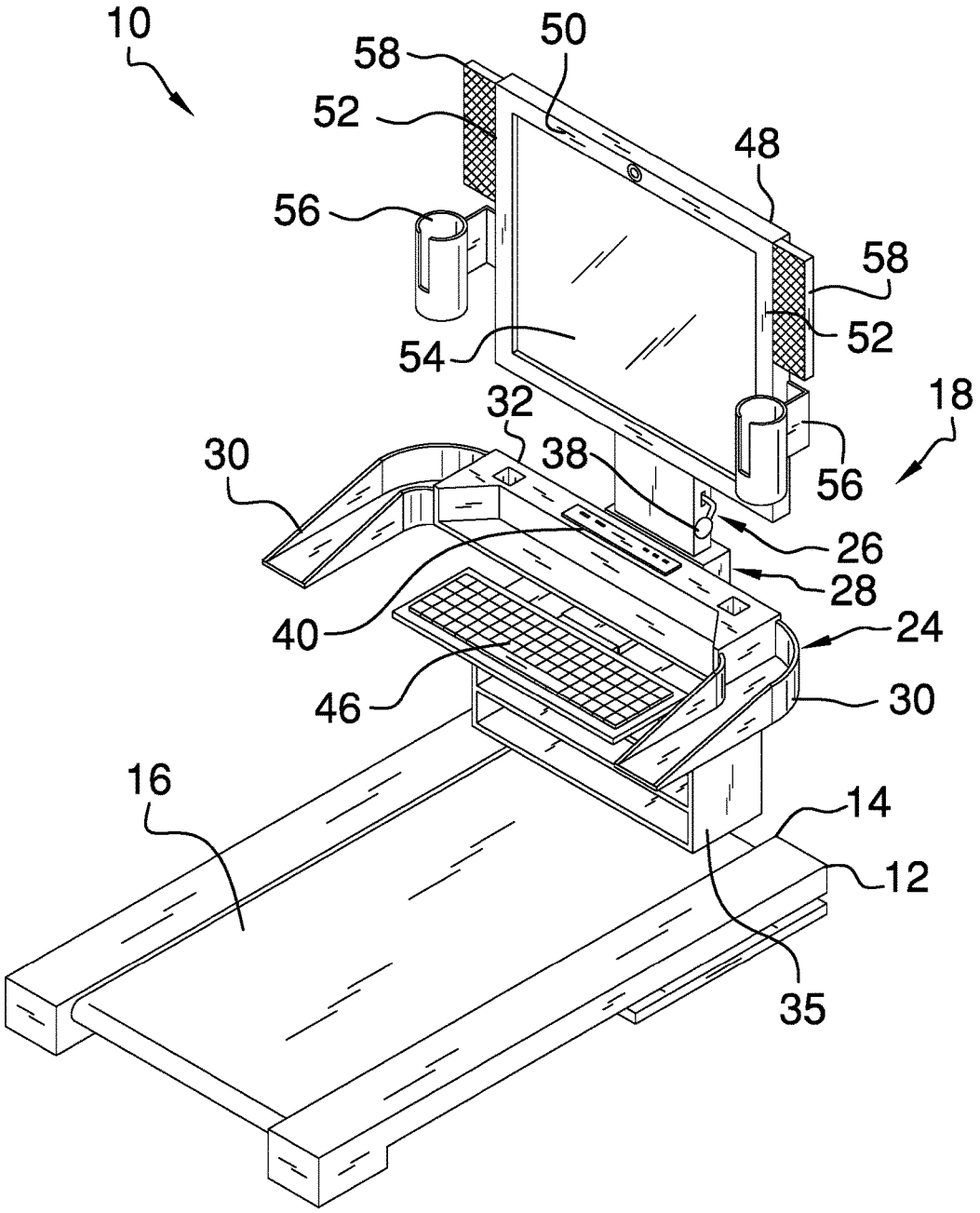
FIG. 1 is a perspective view of an exercise system according to an embodiment of the disclosure.
Figure 2:
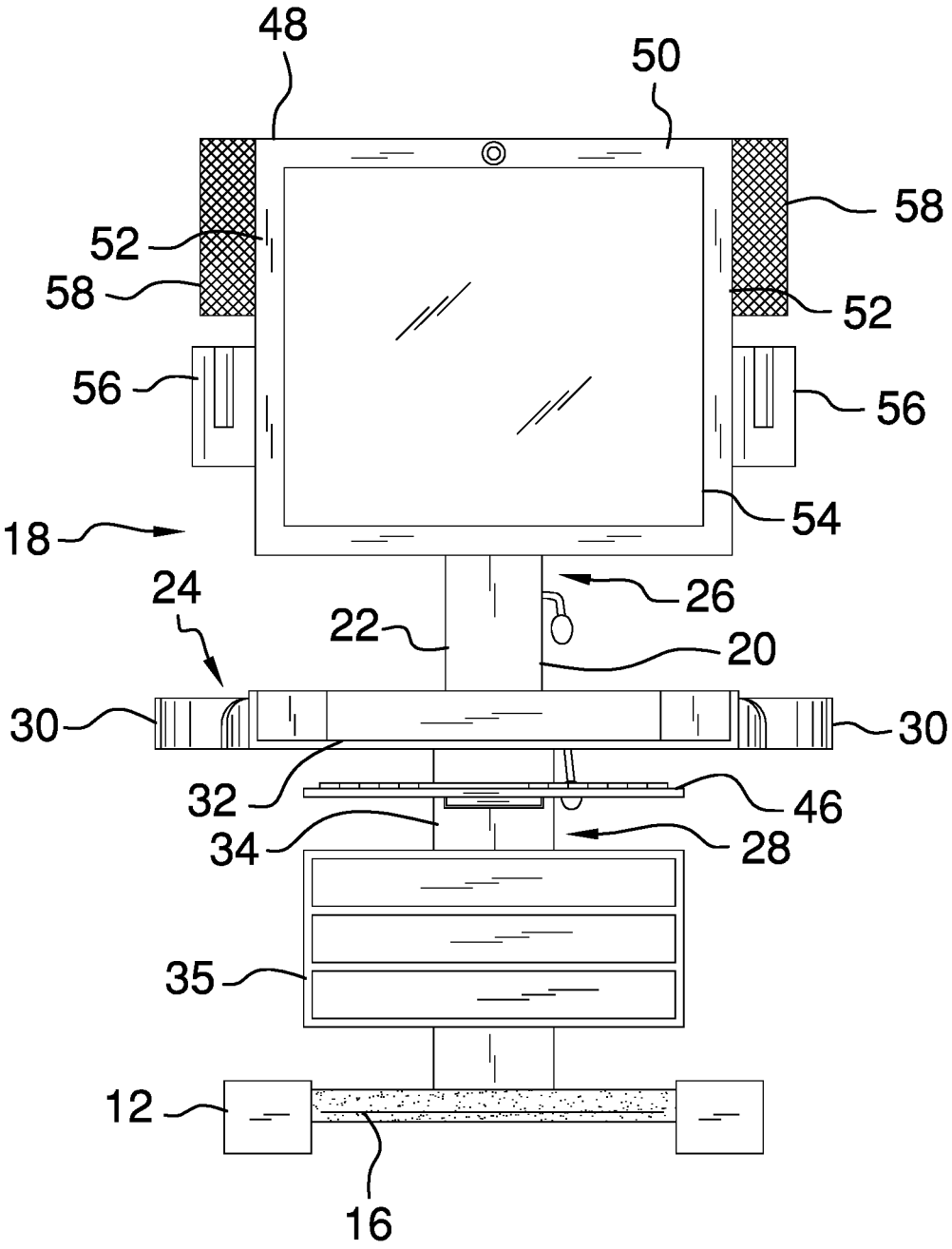
FIG. 2 is a front view of an embodiment of the disclosure.
Figure 3:
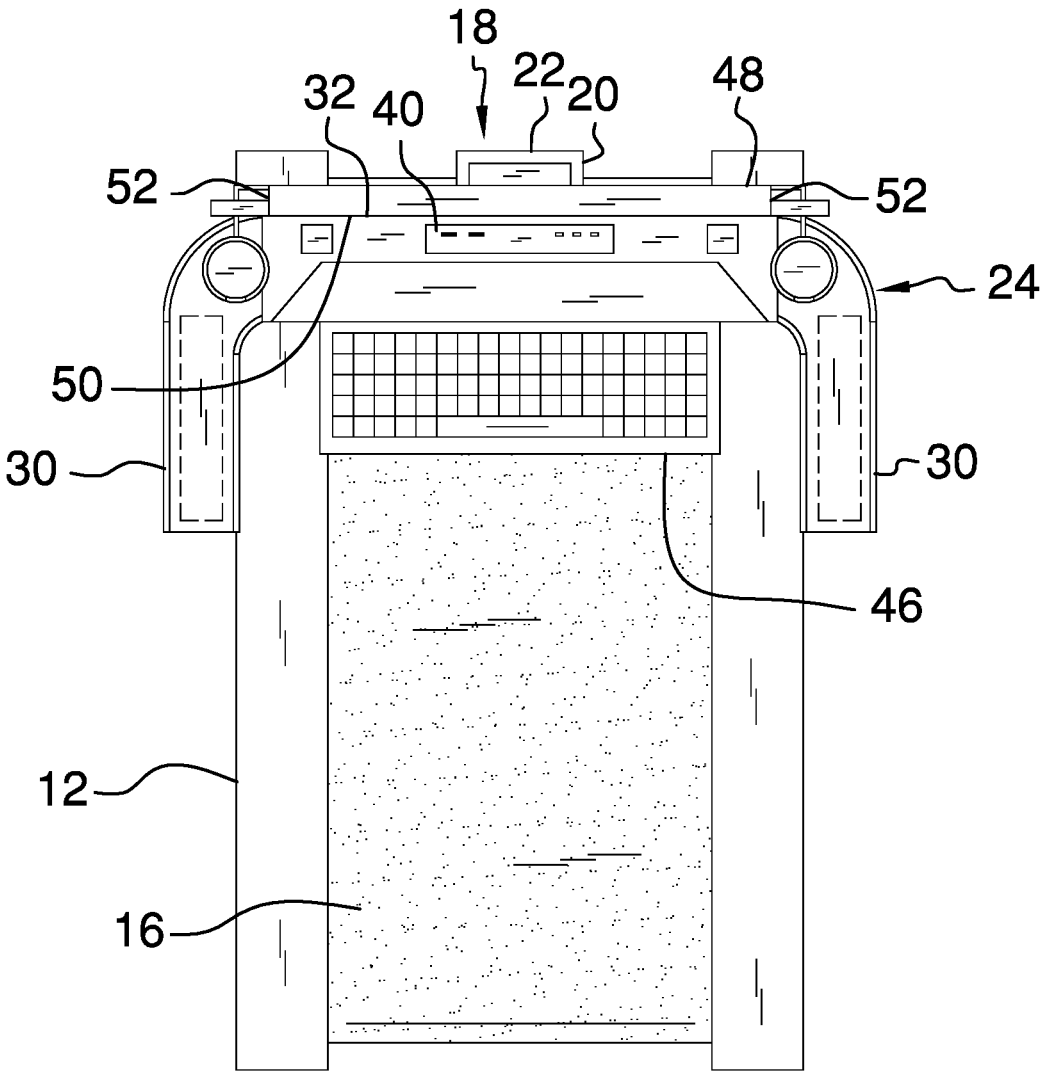
FIG. 3 is a top view of an embodiment of the disclosure.
Figure 4:
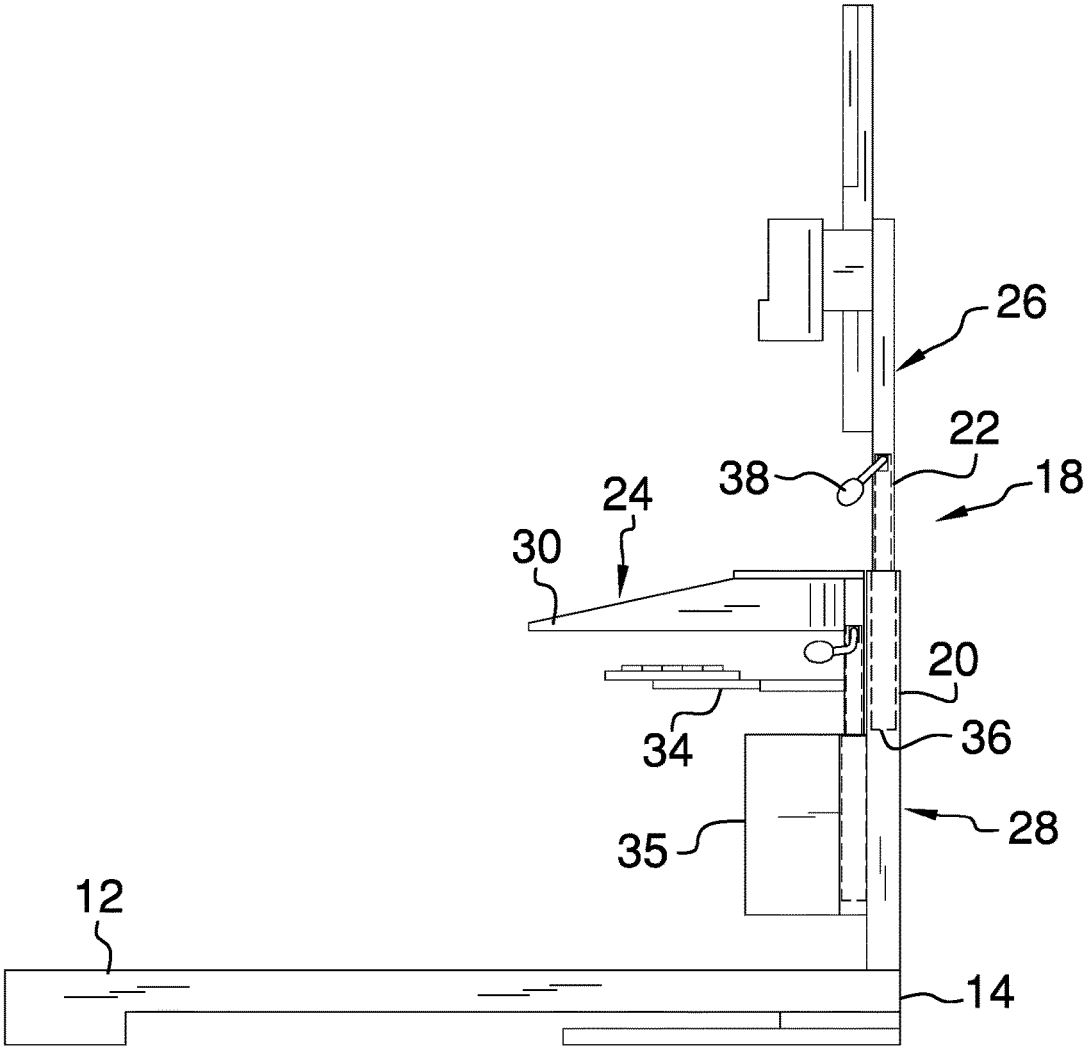
FIG. 4 is a right side view of an embodiment of the disclosure.
Figure 5:
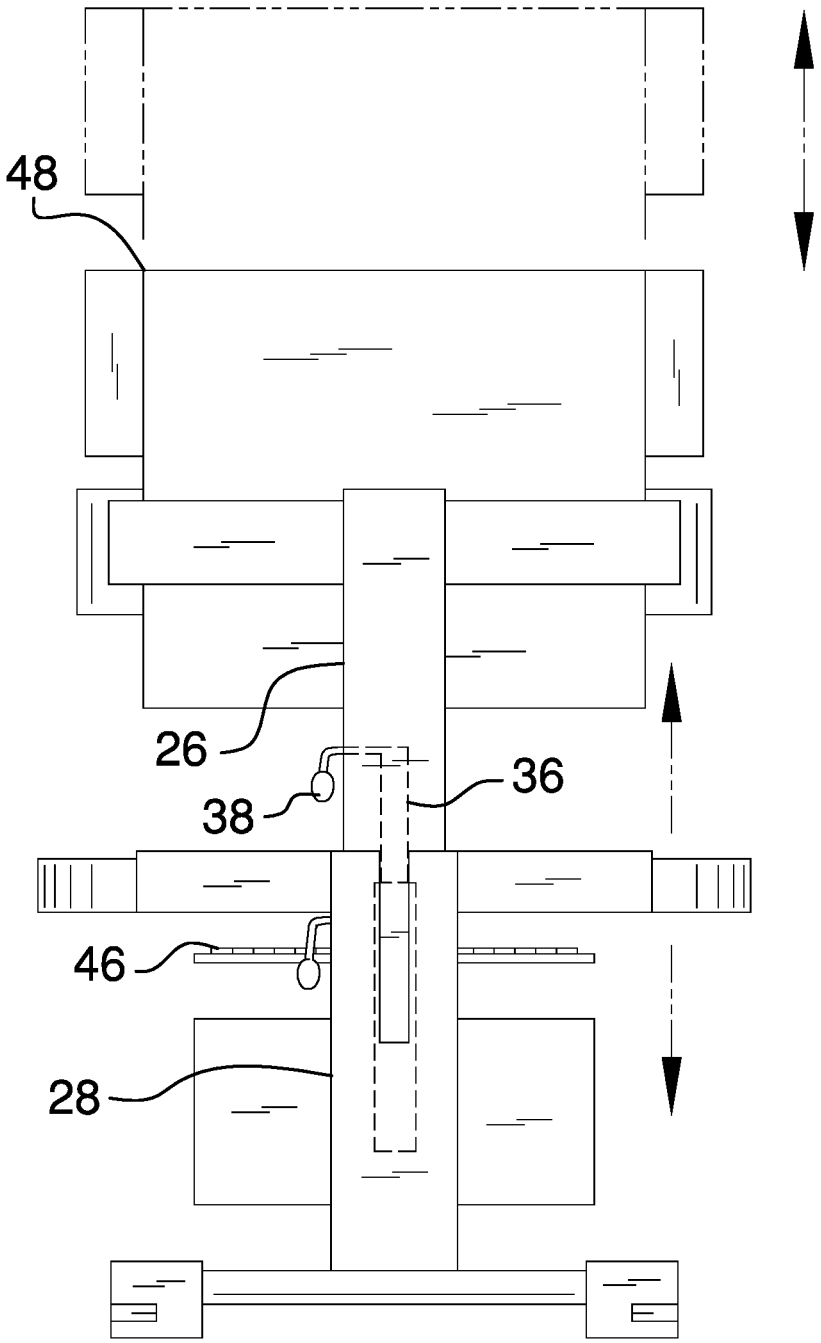
FIG. 5 is a back view of an embodiment of the disclosure.
Figure 6:
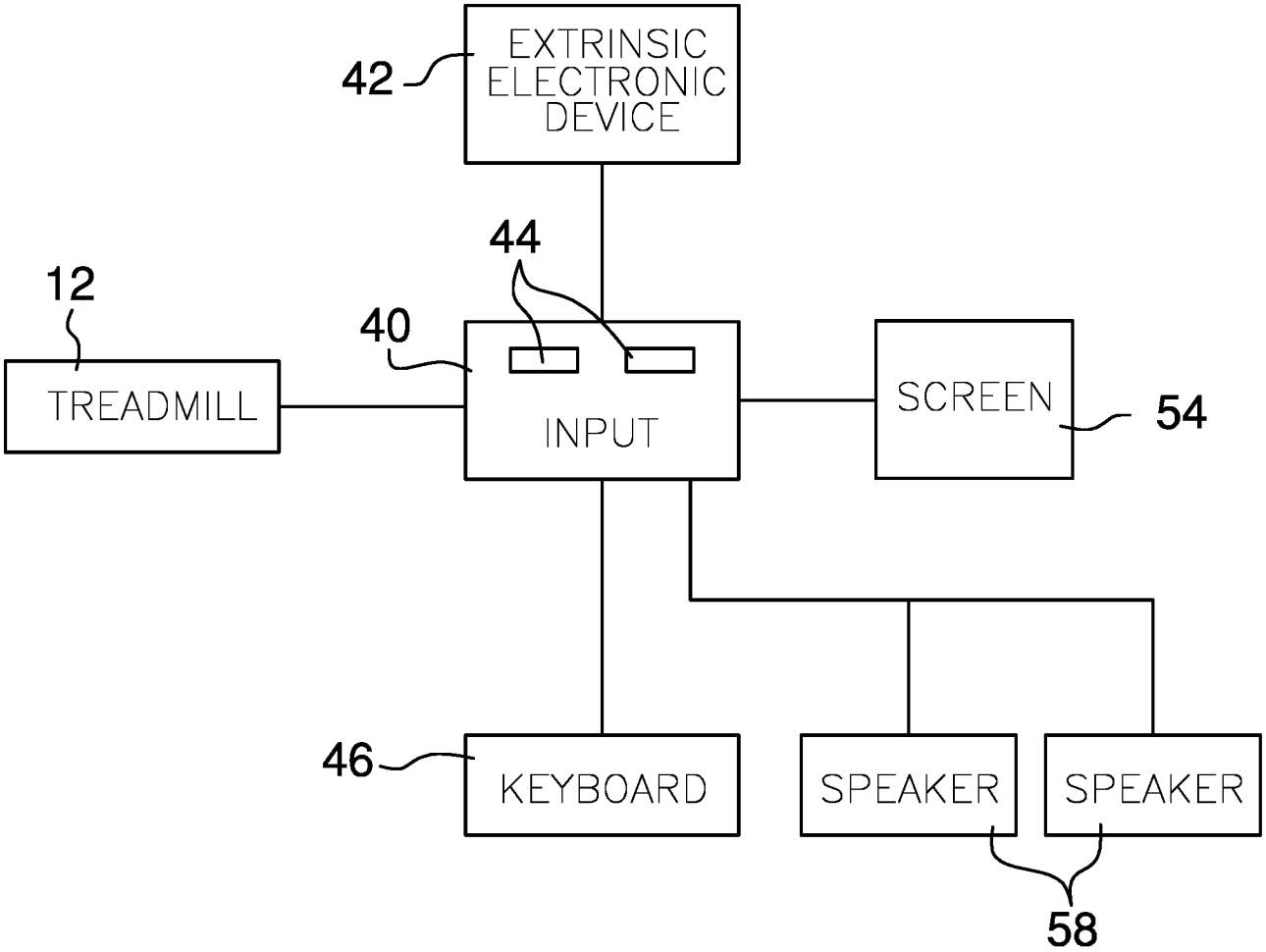
FIG. 6 is a schematic view of an embodiment of the disclosure.

With reference now to the drawings, and in particular to FIGS. 1 through 6 thereof, a new exercise device embodying the principles and concepts of an embodiment of the disclosure and generally designated by the reference numeral 10 will be described.

As best illustrated in FIGS. 1 through 6, the exercise system 10 generally comprises a treadmill 12 that may be walked upon. The treadmill 12 has a first end 14 and a belt 16. The treadmill 12 may be an electric treadmill or the like. A workstation 18 is coupled to the treadmill 12. The workstation 18 is accessible when the treadmill 12 is walked upon thereby facilitating job tasks to be undertaken simultaneously with physical exercise. The job tasks may comprise data entry or other sedentary job tasks associated with digital information.

The workstation 18 comprises a mount 20 that includes an upright 22 and a desk 24. The upright 22 is coupled to and extends upwardly from the treadmill 12 and the upright 22 is positioned on the first end 14. The upright 22 comprises an upper portion 26 that is slidably coupled to a lower portion 28. Thus, the upright 22 has a telescopically adjustable height.

The desk 24 is coupled and extends away from the upright 22 such that the desk 24 is spaced from the belt 16. The desk 24 may support an object thereby facilitating the object to be accessible when the treadmill 12 is walked upon. The desk 24 is positioned on the lower portion 28 and the desk 24 includes a pair of chutes 30 extending away from a central portion 32. The chutes 30 are spaced apart from each other such that the desk 24 has a U-shape. The central portion 32 is coupled to the upright 22 having each of the chutes 30 directed away from the upright 22. Thus, each of chutes 30 may support a pair of arms when the treadmill 12 is walked upon.

The desk 24 includes a platform 34 that is coupled to and extends away from the upright 22. The platform 34 may support an object. The platform 34 is spaced from the belt 16 and the platform 34 is accessible when the treadmill 12 is walked upon. The platform 34 is positioned between the chutes 30.

A bookshelf 35 is provided. The bookshelf 35 is coupled to the upright 22. The bookshelf 35 may be positioned between the desk 24 and the belt 16. The bookshelf 35 may contain objects.

An actuator 36 is coupled between the lower portion 28 and the upper portion 26. The actuator 36 biases the upper portion 26 upwardly with respect to the lower portion 28. The actuator 36 may comprise a hydraulic piston or the like. A lever 38 is coupled to the actuator 36 and the lever 38 may be manipulated. The upper portion 26 is positionable at a selected height with respect to the lower portion 28 when the lever 38 is manipulated. The actuator 36 retains the upper portion 26 at the selected height when the lever 38 is released.

An input 40 is coupled to the desk 24. The input 40 may be electrically coupled to an extrinsic electronic device 42. The input 40 includes a plurality of ports 44. Each of the ports 44 may be positioned on the central portion 32 of the desk 24. The plurality of ports 44 may comprise USB ports and MP3 ports. The extrinsic electronic device 42 may comprise a personal computer, a smart phone or other extrinsic electronic device capable of storing data.

A keyboard 46 is positioned on the platform 34 and the keyboard 46 may be manipulated when the treadmill 12 is walked upon. The keyboard 46 is electrically coupled to the input 40. Thus, the keyboard 46 may control operational parameters of the extrinsic electronic device 42. The keyboard 46 may comprise a QWERTY keyboard or the like.

A display 48 is coupled to the upper portion 26 and the display 48 may be visible when the treadmill 12 is walked upon. The display 48 has a front side 50 and a pair of lateral sides 52. A screen 54 is coupled to the front side 50 of the display 48. The screen 54 is electrically coupled to the input 40 and the screen 54 may display images received from the extrinsic electronic device 42. The screen 54 may comprise an LED display or the like and the screen 54 is electrically coupled to the treadmill 12.

A pair of cup holders 56 is provided. Each of the cup holders 56 is coupled to an associated one of the lateral sides 52 of the display 48. Each of the cup holders 56 may receive a beverage container or the like. A pair of speakers 58 is provided and each of the speakers 58 is coupled to an associated one of the lateral sides 52 of the display 48. Each of the speakers 58 is electrically coupled to the input 40 and each of the speakers 58 may emit audible sounds received from the extrinsic electronic device 42.

In use, the extrinsic electronic device 42 is electrically coupled to the input 40. The treadmill 12 is walked upon. The keyboard 46 and the screen 54 are utilized to complete job tasks while the treadmill 12 is walked upon. Thus, the job tasks are completed in conjunction with physical exercise. The extrinsic electronic device 42 may contain images associated with various landscapes. The screen 54 may display the images thereby simulating a walk through the various landscapes while the treadmill 12 is walked upon.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise system comprising:

a treadmill being configured to be walked upon, said treadmill having a first end and a belt;

a workstation being coupled to said treadmill wherein said workstation is configured to be accessible when said treadmill is walked upon thereby facilitating job tasks to be undertaken simultaneously with physical exercise, said workstation comprises a mount comprising an upright and a desk, said upright being coupled to and extending upwardly from said treadmill, said upright being positioned on said first end, said upright comprising an upper portion being slidably coupled to a lower portion such that said upright has a telescopically adjustable height;

an actuator being coupled between said lower portion and said upper portion, said actuator biasing said upper portion upwardly with respect to said lower portion; and a lever being coupled to said actuator wherein said lever is configured to be manipulated, said upper portion being positionable at a selected height with respect to said lower portion when said lever is manipulated, said actuator retaining said upper portion at the selected height when said lever is released, said lever extending laterally outward from said actuator and extending through a side of said upper portion of said upright and above said desk, wherein said lever is configured to facilitate manipulation of said lever by a user while said treadmill is being walked upon by said user.

2. The system according to claim 1, wherein said desk is coupled to and extends away from said upright such that said desk is spaced from said belt, said desk being configured to support an object thereby facilitating the object to be accessible when said treadmill is walked upon, said desk being positioned on said lower portion.

3. The system according to claim 2, wherein said desk has a pair of chutes extending away from a central portion, said chutes being spaced apart from each other such that said desk has a U-shape, said central portion being coupled to said upright having each of said chutes being directed away from said upright wherein each of chutes is configured to support a pair of arms when said treadmill is walked upon.

4. The system according to claim 2, wherein said desk includes a platform being coupled to and extending away from said upright wherein said platform is configured to support an object, said platform being spaced from said belt wherein said platform is configured to be accessible with said treadmill is walked upon, said platform being positioned between a pair of chutes.

5. The system according to claim 1, further comprising an input being coupled to said desk wherein said input is configured to be electrically coupled to an extrinsic electronic device.

6. The system according to claim 4, further comprising a keyboard being positioned on said platform wherein said keyboard is configured to be manipulated when said treadmill is walked upon, said keyboard being electrically coupled to an input wherein said keyboard is configured to control operational parameters of an extrinsic electronic device.

7. The system according to claim 1, further comprising a display being coupled to said upper portion wherein said display is configured to be visible when said treadmill is walked upon, said display having a front side and a pair of lateral sides.

8. The system according to claim 7, further comprising a screen being coupled to said front side of said display, said screen being electrically coupled to an input wherein said screen is configured to display images received from an extrinsic electronic device.

9. The system according to claim 7, further comprising:

a pair of cup holders, each of said cup holders being coupled to an associated one of said lateral sides of said display; and a pair of speakers, each of said speakers being coupled to an associated one of said lateral sides of said display, each of said speakers being electrically coupled to said input wherein each of said speakers is configured to emit audible sounds received from the extrinsic electronic device.

10. An exercise system comprising:

a treadmill being configured to be walked upon, said treadmill having a first end and a belt; and a workstation being coupled to said treadmill wherein said workstation is configured to be accessible when said treadmill is walked upon thereby facilitating job tasks to be undertaken simultaneously with physical exercise, said workstation comprising:

a mount comprising an upright and a desk, said upright being coupled to and extending upwardly from said treadmill, said upright being positioned on said first end, said upright comprising an upper portion being slidably coupled to a lower portion such that said upright has a telescopically adjustable height, said desk being coupled to and extending away from said upright such that said desk is spaced from said belt, said desk being configured to support an object thereby facilitating the object to be accessible when said treadmill is walked upon, said desk being positioned on said lower portion, said desk having a pair of chutes extending away from a central portion, said chutes being spaced apart from each other such that said desk has a U-shape, said central portion being coupled to said upright having each of said chutes being directed away from said upright wherein each of chutes is configured to support a pair of arms when said treadmill is walked upon, said desk including a platform being coupled to and extending away from said upright wherein said platform is configured to support an object, said platform being spaced from said belt wherein said platform is configured to be accessible with said treadmill is walked upon, said platform being positioned between said chutes, an actuator being coupled between said lower portion and said upper portion, said actuator biasing said upper portion upwardly with respect to said lower portion, a lever being coupled to said actuator wherein said lever is configured to be manipulated, said upper portion being positionable at a selected height with respect to said lower portion when said lever is manipulated, said actuator retaining said upper portion at the selected height when said lever is released, said lever extending laterally outward from said actuator and extending through a side of said upper portion of said upright and above said desk, wherein said lever is configured to facilitate manipulation of said lever by a user while said treadmill is being walked upon by said user;

an input being coupled to said desk wherein said input is configured to be electrically coupled to an extrinsic electronic device, a keyboard being positioned on said platform wherein said keyboard is configured to be manipulated when said treadmill is walked upon, said keyboard being electrically coupled to said input wherein said keyboard is configured to control operational parameters of the extrinsic electronic device, a display being coupled to said upper portion wherein said display is configured to be visible when said treadmill is walked upon, said display having a front side and a pair of lateral sides, a screen being coupled to said front side of said display, said screen being electrically coupled to said input wherein said screen is configured to display images received from the extrinsic electronic device, a pair of cup holders, each of said cup holders being coupled to an associated one of said lateral sides of said display, and a pair of speakers, each of said speakers being coupled to an associated one of said lateral sides of said display, each of said speakers being electrically coupled to said input wherein each of said speakers is configured to emit audible sounds received from the extrinsic electronic device.

* * * * *